US008057276B2

(12) United States Patent
O'Connor

(10) Patent No.: US 8,057,276 B2
(45) Date of Patent: Nov. 15, 2011

(54) TOY

(75) Inventor: Stacy Lynn O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 133 days.

(21) Appl. No.: 12/542,437

(22) Filed: Aug. 17, 2009

(65) Prior Publication Data

US 2010/0041305 A1 Feb. 18, 2010

Related U.S. Application Data

(60) Provisional application No. 61/089,562, filed on Aug. 17, 2008.

(51) Int. Cl.
*A63H 3/46* (2006.01)
*A63H 17/00* (2006.01)

(52) U.S. Cl. ..... 446/381; 446/435; 446/444

(58) Field of Classification Search ..... 446/308–312, 446/435, 444, 446
See application file for complete search history.

(56) References Cited

U.S. PATENT DOCUMENTS

| | | | | |
|---|---|---|---|---|
| 3,862,513 | A * | 1/1975 | Isaacson et al. | 446/381 |
| 4,078,800 | A * | 3/1978 | Goldfarb et al. | 273/317.7 |
| 4,095,367 | A * | 6/1978 | Ogawa | 446/73 |
| 4,383,688 | A * | 5/1983 | Prehodka | 238/10 F |
| 4,511,342 | A * | 4/1985 | Hart et al. | 446/429 |
| 6,676,480 | B2 * | 1/2004 | Sheltman | 446/429 |
| 6,793,554 | B1 * | 9/2004 | Newbold | 446/429 |
| 7,537,506 | B2 * | 5/2009 | de la Torre | 446/353 |
| 7,690,964 | B2 * | 4/2010 | Nuttall et al. | 446/444 |

* cited by examiner

*Primary Examiner* — Kien Nguyen
(74) *Attorney, Agent, or Firm* — Cantor Colburn, LLP

(57) ABSTRACT

Disclosed herein is a toy including a figure and a launcher for launching objects at the figure. The figure has an upper portion and a lower portion wherein the upper portion is movably secured to the lower portion and at least one appendage is movably secured to the upper portion, the at least one appendage having a distal end with an item rotatably secured thereto. An actuator is disposed on an exterior surface of the upper portion of the figure and movement of the actuator causes the upper portion to move from a first configuration to a second configuration with respect to the lower portion.

20 Claims, 8 Drawing Sheets

TOY

CROSS REFERENCE TO RELATED APPLICATIONS

This application claims the benefit of U.S. Provisional Patent Application Ser. No. 61/089,562 filed Aug. 17, 2008, the contents of which are incorporated herein by reference thereto.

BACKGROUND

Various embodiments of the present invention relate to a toy and more particularly, a toy having a figure and a launcher for launching objects at the figure.

Children's toys have included miniature cars, boats, trains, figures, etc. wherein the user's imagination provides for hours of extended play and enjoyment. Toy figures that resemble fighting or combat type activities are particularly popular as the user can participate in imaginary battles.

Accordingly, it is desirable to provide a toy that resembles combat activities and allows for interaction with the user.

SUMMARY OF THE INVENTION

In one embodiment, a toy including a figure and a launcher for launching objects at the figure is provided. The figure has an upper portion and a lower portion wherein the upper portion is movably secured to the lower portion and at least one appendage is movably secured to the upper portion, the at least one appendage having a distal end with an item rotatably secured thereto. An actuator is disposed on an exterior surface of the upper portion of the figure wherein movement of the actuator causes the upper portion to move from a first configuration to a second configuration with respect to the lower portion.

In another embodiment, a toy having a figure and a launcher for launching objects at the figure is disclosed. The figure has a torso portion movably secured to the figure and a pair of arms moveably secured to the torso portion where each of the pair of arms have a distal end with an item to rotatably secured thereto and a motor is provided to simultaneously rotate each item and move the torso such that each item is alternatively located in a position in front of the figure. Objects are launched at the figure in order to release a release mechanism that maintains the torso in an upright configuration.

BRIEF DESCRIPTION OF THE DRAWINGS

Other features, advantages and details appear, by way of example only, in the following description of embodiments, the description referring to the drawings in which.

DETAILED DESCRIPTION

Figure 1:
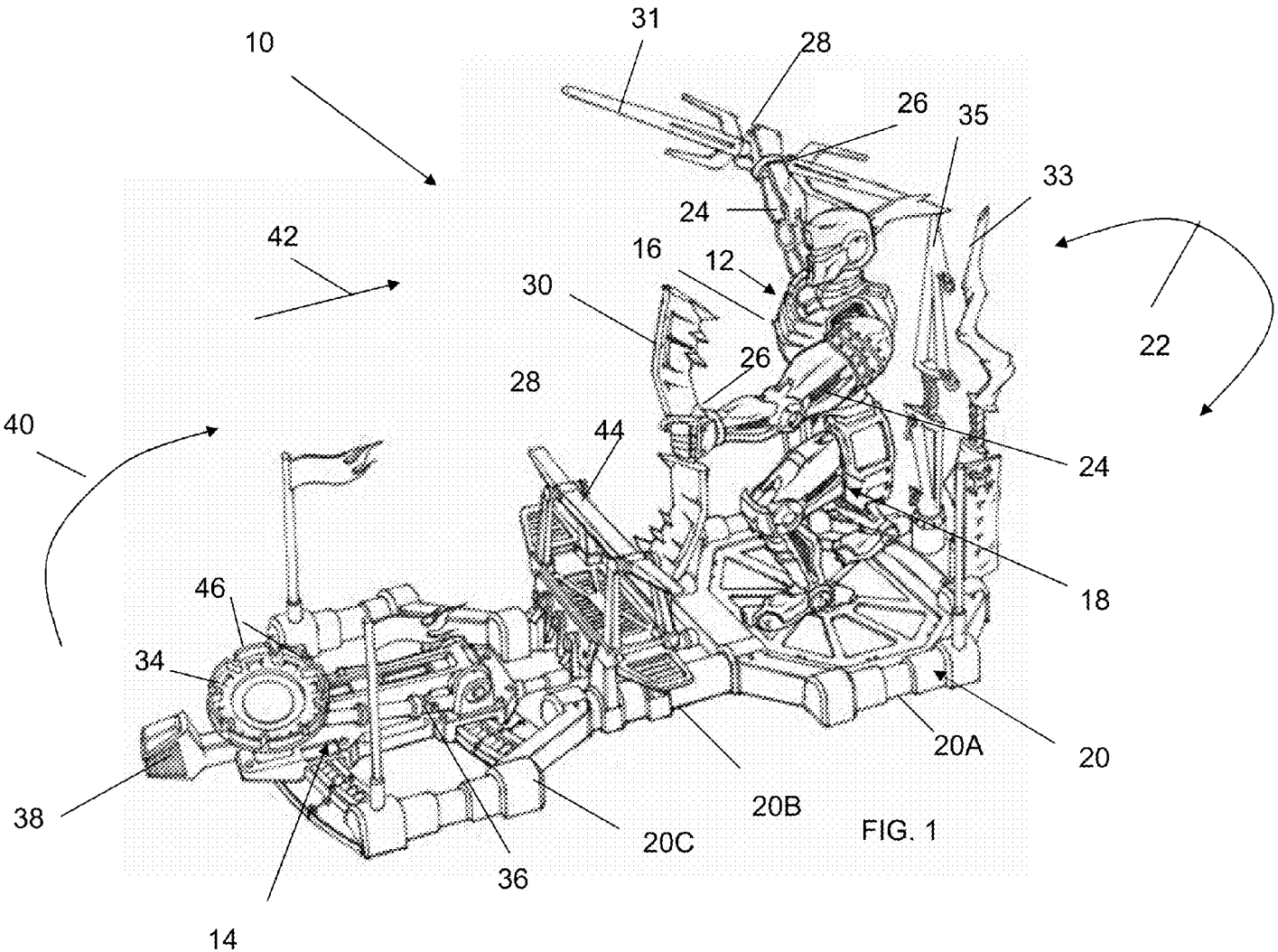
FIG. 1 is a perspective view of a toy in accordance with one embodiment of the present invention.
Figure 3:
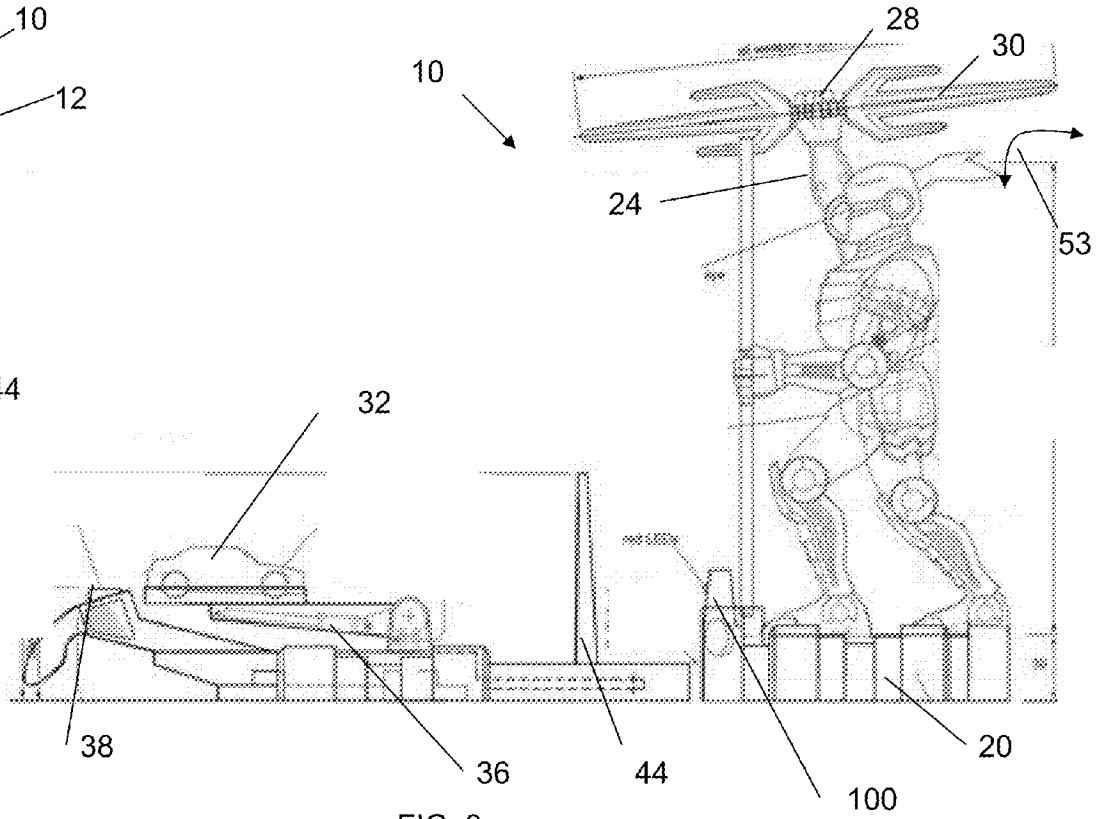
FIG. 3 is a side elevational view of the toy depicted in FIG. 1.
Figure 2:
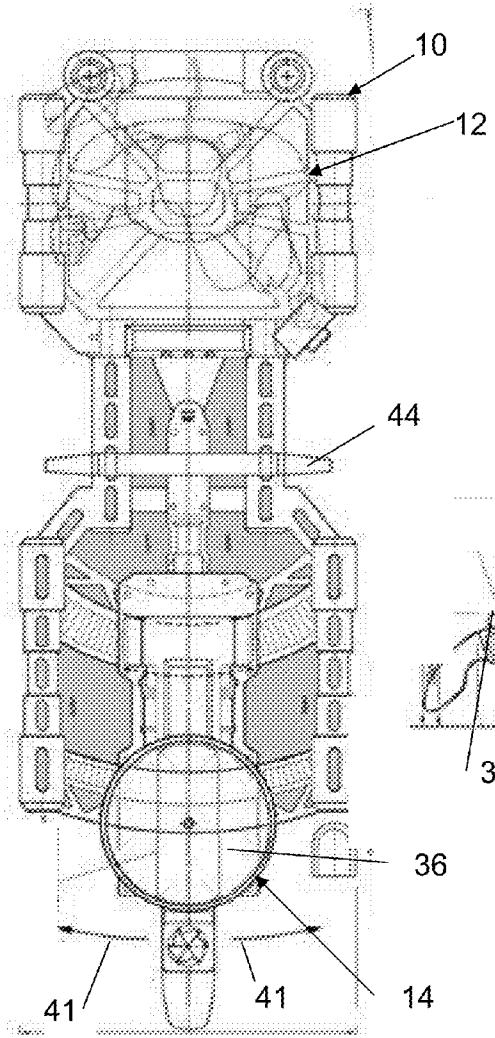
FIG. 2 is a top plan view of the toy depicted in FIG. 1.

In accordance with various embodiments of the present invention a toy is provided. Referring now to FIGS. 1-3, a toy 10 constructed in accordance with one non-limiting embodiment is illustrated. In accordance with exemplary embodiments of the present invention portions of the toy as described herein may be formed out of an easily molded material such as plastic or any other equivalent materials. As will be further discussed herein, the toy has various embodiments or combinations wherein an opponent, target or figure of the toy moves or sequences through a plurality of positions or defensive postures wherein rotating implements of the same either protect or expose a portion of the figure, opponent or target. In one embodiment, the figure will resemble a human, humanoid, robot, character or any other type of configuration that can be employed as a portion of the toy having a target for objects to be launched at. The portion will in one embodiment have an actuator which when struck by an object will cause the figure or opponent to collapse or take on a defeated posture. The toy will also include a launcher that is capable of launching an object or item at the portion of the opponent containing the actuator. The launcher will be capable of being positioned into various configurations such that the object can be aimed at the relevant portion of the figure.

In one alternative embodiment, the toy or figure will include an audio device configured to provide audio outputs such as taunts to the user launching objects at the figure. One contemplated variation would include audio outputs that are synchronized with actions of the toy, for example, during initiation of game play by placing an item in the hand of the opponent will cause the toy to play an audio track that constitutes a challenge, for example: "So you have decided to challenge the master. To win you must battle my Dragon Blade and Snake Staff" or "Put these weapons into my hands and place a car on the Battle Stand for our challenge to begin." This will be caused by actuation of certain sensors as will be discussed herein.

Furthermore, and as objects are launched at the opponent audio tracks can be played when a user misses the actuator of the opponent or alternatively hits the actuator of the opponent or alternatively when the trigger is released or depressed when the figure is in a specific or predetermined position. In any of the embodiments, the audio tracks can be keyed into actuation of the launcher wherein a first signal is created and actuation of the actuator on the opponent creates a second signal thus, audio tracks will be played based upon receipt of the first signal and/or receipt of the first signal and the second signal. Non-limiting examples of such audio tracks are as follows: "Is that all you have!" or "You have some skill, but not enough to defeat me." etc. Further embodiments contemplate a scoreboard or item indicating the number of successful rounds the player has had.

As illustrated, toy 10 has a FIG. 12 and a launcher 14. FIG. 12 has an upper portion or torso 16 and a lower portion 18. As used herein, the figure is intended to provide a target at which objects are launched. In one embodiment, lower portion 18 has a pair of legs secured to a base structure 20 of the toy. In one alternative embodiment, the base structure 20 will have a plurality of parts 20A, 20B, 20C each of which correspond to a particular portion of the toy and are removably secured to each other. For example, in one embodiment part 20A will comprise the launcher, part 20B will comprise a middle section having the obstacle and part 20C will comprise the figure. The upper portion or torso 16 is movably secured to the lower portion 18 such that upper portion or torso 16 can move or twist in a reciprocal motion in the direction of arrows 22. In addition, the upper portion or torso will have a pair of arms or appendages 24. The arms or appendages are movably secured to the upper portion or torso for various positions with respect to the figure. In addition and as illustrated, at a distal end 26 of each of the arms, a hand 28 of the figure is rotatably received. Each hand is configured to releaseably grip an item or items (30, 31, 33, etc.) each of which has an alternative configuration which in one embodiment are shaped as different weapons. Of course, other items can be releasably gripped by the hand. Rotation or movement of the hand will cause rotation or movement of the item being gripped by the hand. As will be discussed herein, movement of the hands, the arms and the torso of the figure is provided such that the items of the figure are rotated to provide a spinning shield or a means for blocking an object launched at the figure. In one embodiment, a plurality of items 30 are removably stored or secured to the base such that various combinations can be provided.

The launcher is configured to launch objects 32 at the figure. In one embodiment, the launcher resembles and/or operates like a catapult wherein the launcher is pulled back to a launching or cocked position wherein a biasing force is provided to move the launcher from the cocked position to another position and abruptly stop and then an object 32 is launched by the launcher.

In one embodiment, the object is a miniature car that is supported on platform 36. Of course, other objects can be placed on the platform for launching at the target, opponent or figure. Accordingly, variations in play are provided. As illustrated, the launcher has a platform 34 that is pivotally secured to the base via an arm member or members 36. The launcher is illustrated in a cocked or prelaunch position in FIG. 1. The launcher is held in the place by a trigger 38 wherein movement of the trigger 38 will release a biasing force and cause the platform to pivot in the direction of the arrow 40 and launch an object in the direction of arrow 42 at the figure. The launcher is also capable of movement in the direction of arrows 41. As illustrated in FIGS. 1-3 and in one embodiment, a structure 44 is positioned between the FIG. 12 and the launcher 14. In this embodiment, the object must clear the structure in order to hit the figure.

Referring back now to FIG. 1 the platform has a plurality of tabs 46 disposed around the periphery of the platform. Each of the tabs are configured such that the miniature car or object 32 can be positioned on the platform in a variety of angular configurations wherein portions of the car are received within gaps defined between the tabs. As illustrated, the platform has a circular configuration and the plurality of tabs are disposed along the periphery of the circular configuration. However, it is understood that the platform can have a variety of other configurations (e.g., non-circular, rectangle, square, etc.) See also FIGS. 9A and 9B wherein the platform is defined by tab members disposed in an inner periphery of a ring structure. In yet another alternative embodiment, the platform can be constructed without the plurality of tabs furthermore exemplary embodiments contemplate any type of object being propelled by the launcher.

Referring now to FIGS. 1-4 additional features will be further described here, a motor 50 provides a rotational force to a gear train 52. The gear train or at least a portion thereof is disposed within the torso and the arms of the figure such that application of a driving force to the gear train will cause three separate yet related events to occur. For example and during application of the driving force by the motor, the torso will move laterally or twist back-and-forth in the direction of arrows 22 while the arms will move up and down in the direction of arrows 53 and the hands of each of the arms will rotate with respect to the arms such that the item being held by the hand will rotate in a circular fashion, creating a shield.

In order to provide this movement a gear 54 of the motor is rotated when the motor is energized. Gear 54 meshingly engages a gear 56 secured to a cross member 58 of the gear train such that upon application of a driving force to gear 56 member 58 rotates and a pair of gear members 60 disposed at either end of member 58 also rotate and each gear member 60 engages a gear member 62 disposed within an arm of the figure. Each gear 62 is angularly configured such that rotation of gear 62 cause the arms to move upward and downward in a reciprocal motion in the direction of arrows 54 as the torso twists. Furthermore, each gear 62 is also secured to a shaft member 64 having another gear 68 disposed at an opposite end. Gears 68 are positioned to meshingly engage gears 70 disposed within forearms 74 of the arms of the figure. Gears 70 are also secured to a shaft member 72 rotatably received in the forearms of the figure and one end of the shaft member is secured to hands 28 rotatably received within the forearms. Accordingly, rotation of gears 62 causes rotation of gear 68 via shaft member 64 which in turn causes rotation of gears 70 and shaft member 72 such that the hands 28 rotatably received within the forearms are rotated in a circular fashion. Therefore, items 30 held in hands 28 will rotate in a circular manner when motor 50 provides a driving force to the gear train 52. It being understood that each of the shaft members in gears are rotatably received within cavities of the figure such that application of the driving force to the gear train will cause the desired movement (e.g., rotation of the hands and items grasped by the hands, movement of the arms up and down and twisting of the torso in a back-and-forth manner). Although one embodiment is directed to rotation of the hands and the items recently secured therein, it is also understood that various embodiments of the present invention contemplate other types of movements of the hands and the items releasably secured therein, for example, twisting or bending motion, pivoting motion, etc.

Figure 4:
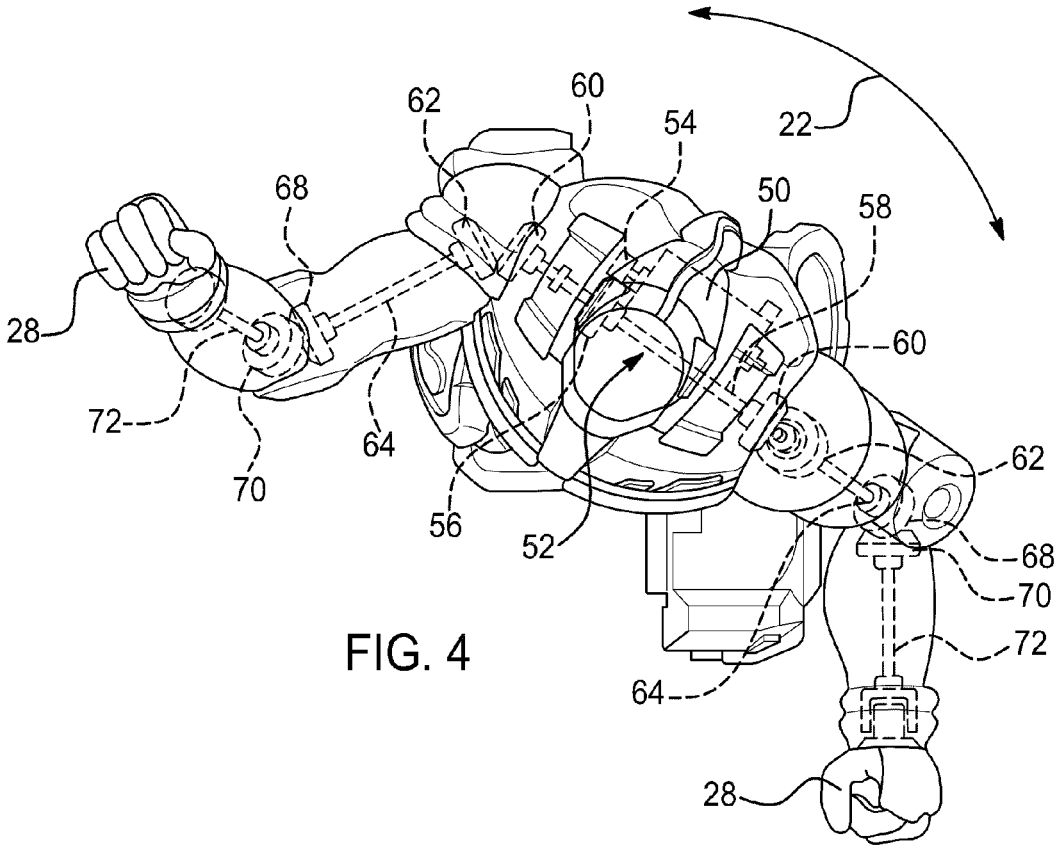
FIG. 4 is a top perspective view of a portion of the toy in accordance with an embodiment of the present invention.

As illustrated in FIGS. 4 and 10A-10B and in order to cause the twisting of the torso in a back-and-forth manner, shaft member 58 will have a rack or screw portion such that rotation of gear 56 will cause the same to translate in a linear manner along member 58 wherein rotation of the torso is facilitated alternatively, gear 56 or gear 54 of the motor will engage another gear (not shown) to cause the back-and-forth rotation (e.g., twisting) of the torso of the figure manner.

Alternative methods for achieving the desired movement of the torso, arms and weapons of the figure are contemplated, for example, a manual method or means for manually actuating the movement of the weapons, arms and torso may be employed.

Figure 5A:
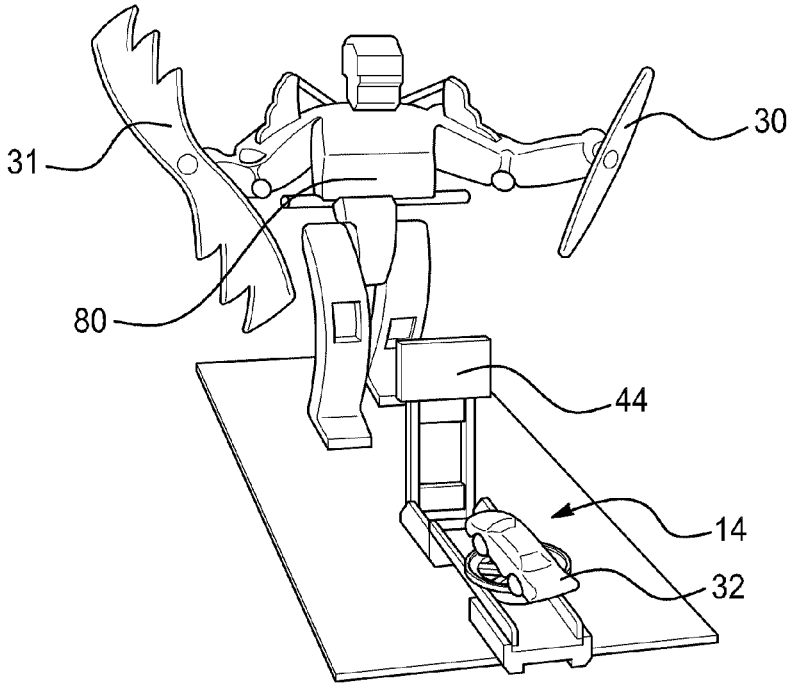
FIGS. 5A-5E are views illustrating movement of the toy in accordance with one embodiment of the present invention.
Figure 5B:
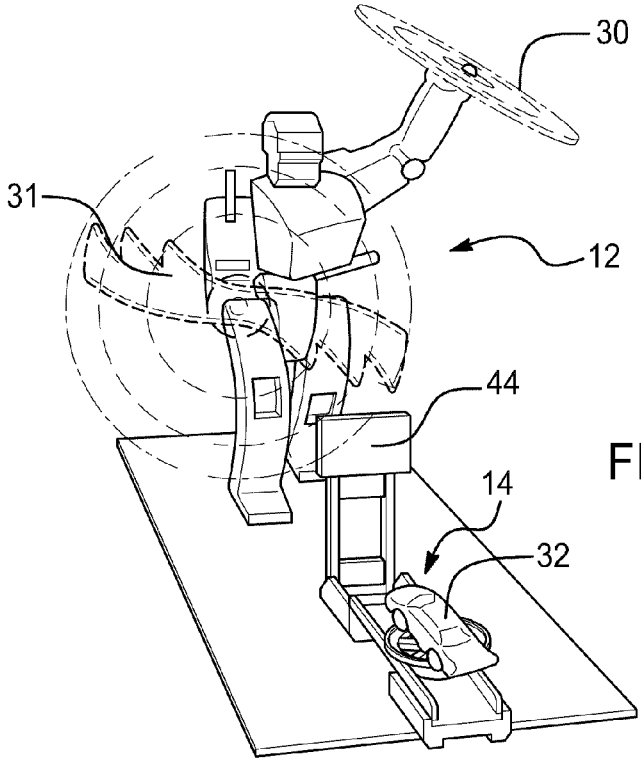

Referring now to FIGS. 5A-5E movement of the FIG. 12 and the launcher 14 of one embodiment is illustrated. Here a simplified version of the toy illustrated in FIGS. 1-4 is provided in FIGS. 5A-5E. Figure FIG. 5A illustrates the toy 10 when the motor of the figure is not energized thus items 30, 31, 33, 35 are not being moved and the launcher is in a cocked position and object 32 is located on the launcher. Here an obstacle 44 is positioned between the launcher and the FIG. 12 thus, object 32 must clear the obstacle in order to strike a chest area 80 of the figure. Of course, other embodiments contemplate a toy without an obstacle disposed between the launcher and the figure. FIG. 5B illustrates movement of the figure once the motor is energized. Here the torso or upper portion 16 of the figure rotates toward the right and the right arm is moved downward while of the item 31 held in the right-hand is rotated in a circular fashion thus protecting the chest of the figure from the object being launched by the launcher. Also shown is that the left arm is moved upward and the item 30 held in the left hand is also being rotated in a circular fashion however, this item is not blocking the chest of the figure.

Figure 5C:
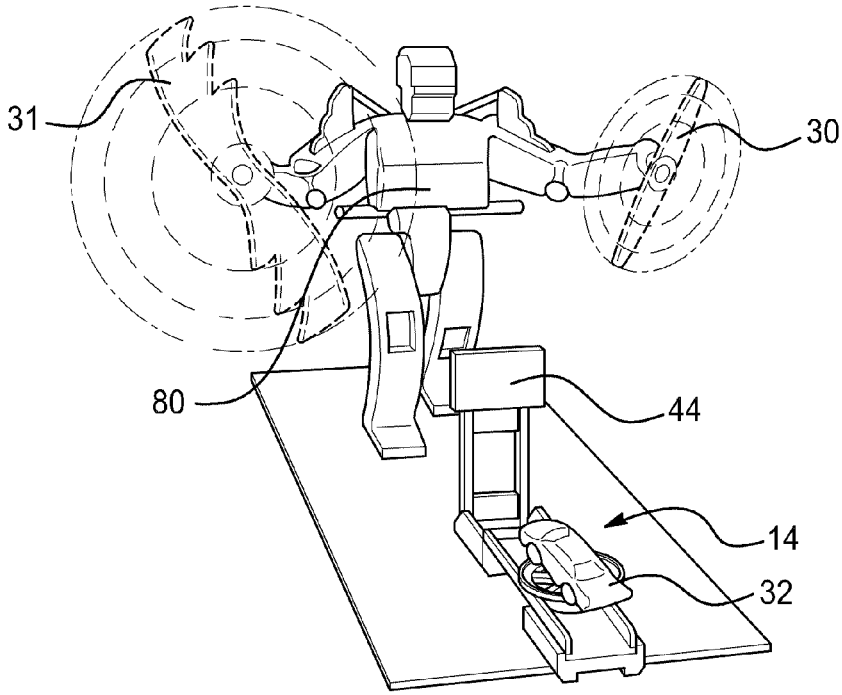

Referring now to FIG. 5C the figure has translated from the position in FIG. 5B. Here the torso has rotated to the right and the left arm has moved downward while the right arm has moved upward and each of the items held in the hands are still being rotated. In this position the chest area 80 of the figure is exposed to objects 32 being launched by the launching device.

Figure 5D:
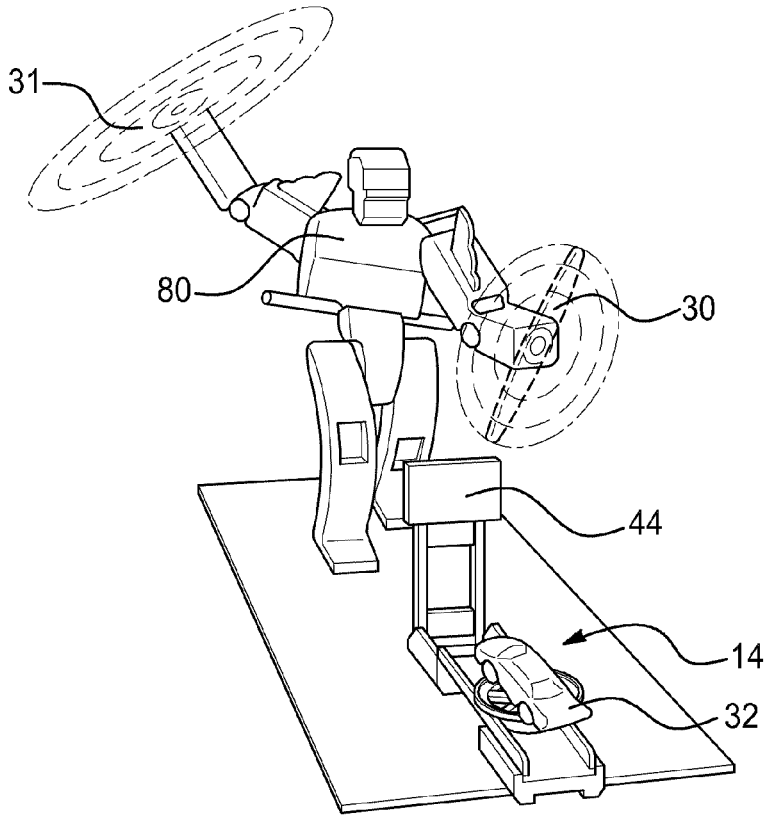

Referring now to FIG. 5D the figure has translated from the position in FIG. 5C. Here the torso has rotated still further to the right and the left arm has moved further downward while the right arm has moved further upward and each of the items held in the hands are still being rotated. In this position, the chest area 80 of the figure is protected from objects launched by the launching device as the circular rotation of the weapon in the left hand provides a circular area of protection or shield such that launching of an object at the figure when it is in this position will most likely be deflected away from the figure since the object will hit the rotating item. Although circular configurations are mentioned it is, of course, understood that non-circular configurations of rotating or moving objects held in the hands or distal ends of the figure are considered to be within the scope of various embodiments of the present invention.

Figure 5E:
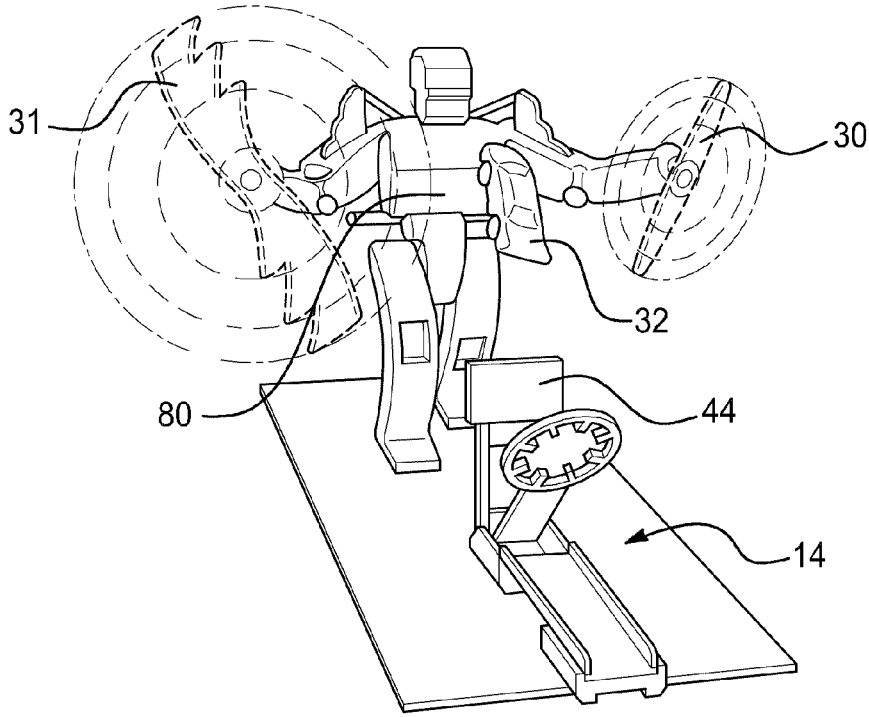

Referring now to FIG. 5E the figure has translated from the position in FIG. 5D. Here the torso 16 has rotated to the left from one limit of travel of the torso in the right direction (e.g., the position illustrated in FIG. 5D) and the left arm has moved upward from a lower limit of travel (e.g., the position illustrated in FIG. 5D) while the right arm has moved downward from an upper limit of travel (e.g., the position illustrated in FIG. 5D) and each of the items 30, 31 held in the hands are still being rotated. In this position however, the chest area 80 of the figure is not protected from objects launched by the launching device as the circular rotation of the weapon provides circular areas of protection and these areas of protection do not cover or protect the chest area 80 of the figure in this configuration. Accordingly and as illustrated, it is at this position when the object should be launched by the launching device. As shown, the trigger of the launching device 14 has been actuated and the launching device has been pivoted upward and away from the base and the object has been launched at device and due to the position of the arms and chest of the figure the chest is capable of being struck by the object.

Figure 6A:
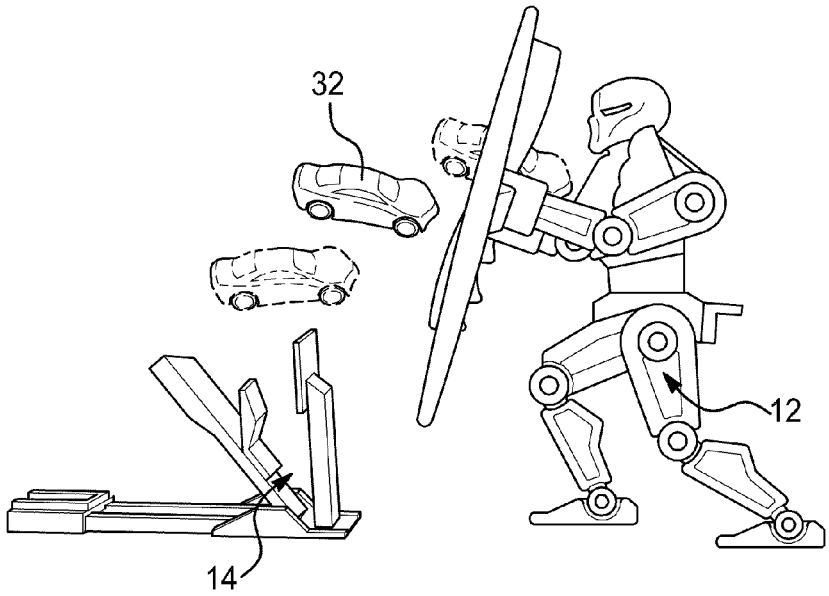
FIGS. 6A-6B are views illustrating movement of the toy in accordance with one embodiment of the present invention.
Figure 6B:
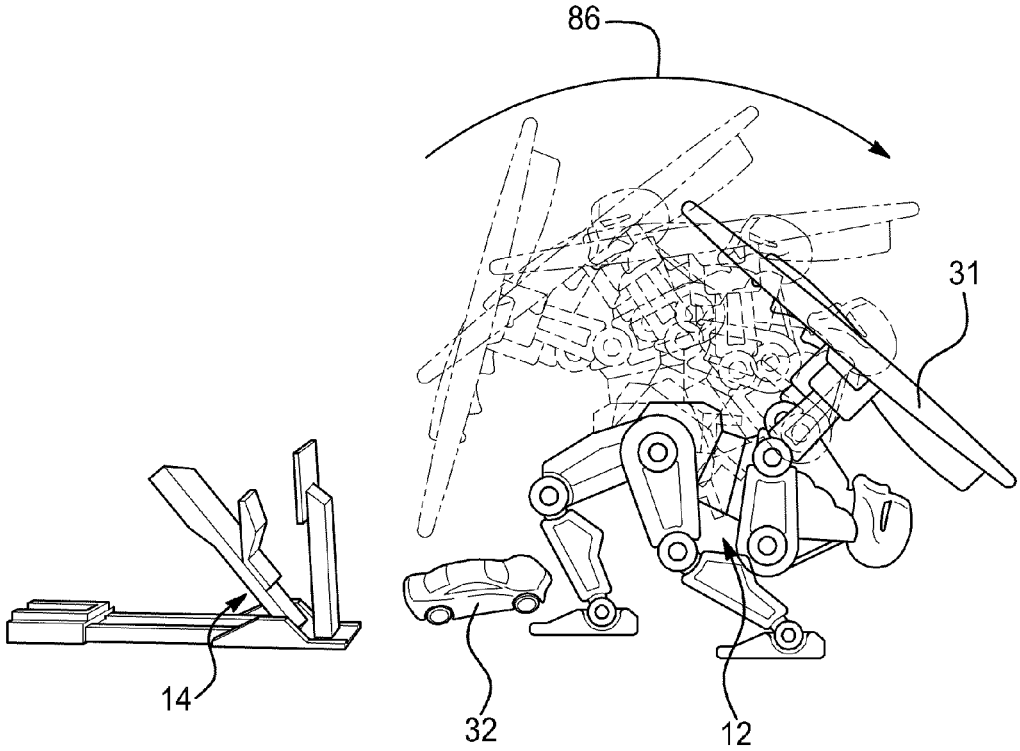
Figure 6C:
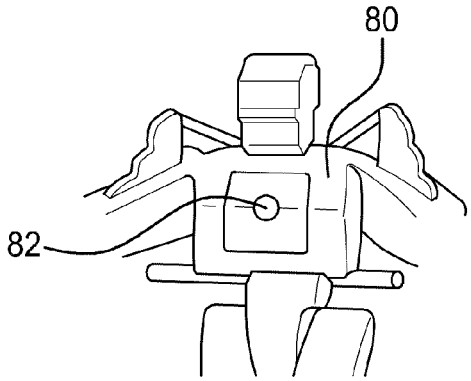
FIG. 6C is a view illustrating a portion of the toy in accordance with one embodiment of the present invention.

As will be discussed herein and referring now to FIGS. 6A-6D, another feature of an embodiment of the present invention will be illustrated. Here, the chest portion 80 is configured to have an actuator or trigger 82 operably coupled to a release mechanism 84 (FIG. 6D) that retains the torso or upper portion of the figure in an upright position (FIG. 6A). In one embodiment, the upper portion or torso of the figure is maintained in the upright configuration or position by the release mechanism and the torso is pivotally secured to a lower portion of the figure for movement between the upright position (FIG. 6A) and a knocked down or non-upright position (FIG. 6B). One non-limiting release mechanism includes a biasing member to move or rotate one portion of the opponent in the direction of arrow 86 such that upon release of the release mechanism by striking the same with an object, the opponent is moved from the upright position (FIG. 6A) to the knocked down or non-upright position (FIG. 6B). When resetting the opponent from the knock down position the movable portion of the opponent is moved back into the upright position and the biasing member or spring is compressed such that a biasing force in the direction of arrow 86 is created so that further actuation of the release member will once again cause the opponent to translate from the upright position to be knocked down position. In addition, the release mechanism is configured such that the same will provide a releasable latching feature in order to secure the torso in the upright position. Accordingly, movement of the actuator causes the release mechanism to release the biasing force in the direction of arrow 86 and pivot or rotate the torso into the knocked down position illustrated in FIG. 6B. FIG. 6C illustrates a chest portion of the figure wherein actuator 82 is positioned on an exterior surface of the figure such that when an object strikes the chest portion of the figure actuator 82 is depressed and the release mechanism releases the biasing force of the spring and the upper portion of the figure rotates into the knocked down position illustrated in FIG. 6B.

Figure 6D:
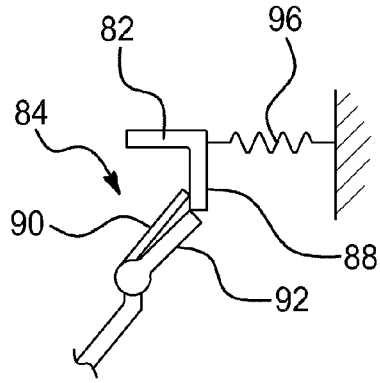
FIG. 6D is a schematic view of a release mechanism for maintaining a portion of the figure in a first configuration.

One non-limiting configuration of release mechanism 84 is illustrated schematically in FIG. 6D wherein actuator 82 has a latch member 88 that will engage a portion of a spring 90 and a portion 92 of the upper torso pivotally secured to another portion of the figure such that movement of the actuator will cause the biasing force of the spring to be released and act upon the portion 92 that was engaged by latch member 88 thereby causing the figure to translate from an upright configuration to a knocked down configuration. In other words, if the actuator 82 is struck by the object launched by the launcher the figure is defeated and will pivot or fall backwards. Once the figure has been knocked down or pushed backwards to the position illustrated in FIG. 6B and in order to reset the toy for further play, the upper portion is merely rotated back in a direction opposite to the direction of arrow 86 and portion 92 moves with the upper portion of the torso such that a biasing force is created by spring 90 since it is also rotated backwards and portion 92 is engaged by latch member 82 such that the upper portion is now retained in the upright configuration illustrated in FIG. 6A. In order to maintain the actuator 82, spring 90 and portion 92 in the position corresponding to the upright position of the upper torso a spring or biasing member 96 is provided. Biasing member 96 will provide a biasing force such that the upper torso of the figure will be retained in the upright configuration until actuator 82 is depressed or hit by an object launched by the launcher.

Of course, numerous other means for retaining and knocking down the upper portion of the figure are contemplated to be within the scope of exemplary embodiments of the present invention.

As discussed herein, a toy is provided wherein a figure moves or sequences through a plurality of positions or defensive postures wherein rotating weapons either protect or expose a portion of the figure. The portion of the figure includes an actuator which when struck by an object will cause the figure to collapse or take on a defeated posture. The toy will include a launcher that is capable of launching an item at the portion of the figure containing the actuator. In one embodiment, the launcher will be capable of being positioned into various configurations such that the object can be aimed at the relevant portion of the figure.

In an alternative embodiment, the toy has various levels and each defeat or knock down of the figure is recorded until a predetermined amount of defeats are recorded and the player can advance to another level. In one alternative embodiment, the figure also contains a speaker and audio driver for playing a plurality of prerecorded messages during game play.

In one non-limiting embodiment, the figure is configured as a Ninja warrior and levels are obtained by defeating the Ninja (e.g., each level won by the player advances the player in belt ranking (Novice, Red belt, Brown belt, Black belt and Master) and accordingly the player's goal is to defeat the Ninja through consecutive rounds of battle and become the master.

When the player strikes the chest enough times the figure or Ninja collapses backwards and the player has won the round. The player then lifts (resets) the Ninja, and in one embodiment a new level or ranking appears on a score area 100. In one embodiment, the score area may include lights or LEDs that light up each time a level is completed.

One non-limiting example of play of the toy is as follows: a plurality of battle rounds are played against the Ninja or figure wherein a score is kept. Here each level or round won by the player advances the player in belt ranking wherein the player's goal is to defeat the figure through the four or any number of consecutive rounds of battle.

In one pattern, the programming will be set up to sequence though a plurality of steps. For example, once the toy is switched on the figure performs a few waist twists, weapon spins and then pauses then the audio track plays and says, "So you have decided to challenge the master". In order to advance to another belt level the player must defeat the figure, wherein different items for each level are placed in the figure's hands (e.g., different weapons can be used for each round of battle). In one embodiment, the figure issues an audio command like "Put these weapons into my hands and place a car on the Battle Stand for our challenge to begin." If the player puts correct weapons in the figure's hands and places a car or other object on the Battle Stand, the figure will provide a comment initiating game play.

Then the figure begins performing random waist twists and weapon spins and the figure can provide taunts to the player by saying phrases such as, "Take your best shot" or "I'm waiting."

The player aims the launcher and tries to vault a car or object between the spinning weapons and hit the figure's chest plate. The car can be placed on the launcher at different angles for a variety of attack styles (side flip, back flip, forward flip, etc.).

Battle Outcome: if the player misses the chest plate and the figure knocks the car out of the air with his spinning weapons, the figure may further reply will additional audio tracks, etc. If the car hits the figure's chest plate alternative audio replies related to the success of the player. In one embodiment, the battle continues as before and when the player strikes the chest plate enough times the figure collapses backwards and the player has won the round. The player then lifts (resets) the figure, and a new belt ranking appears on the base or battle stand (e.g., illuminating LEDs of different colors or number which indicate advancement of play) and then an audio track may play that indicates an advancement in ranking (e.g., brown belt or black belt). At this point, the next round begins and the figure requests a new weapon to achieve a new ranking.

In one alternative embodiment and if however, the player does not strike the figure's chest plate enough times within a given a round, the figure knocks the car off of the Battle Stand and provides taunting audio tracks. In one embodiment, the toy is configured so that the figure knocks the car off the stand when one of the spinning weapons, controlled by the motor/circuit, reverses direction and the weapon strikes a ratchet lever on the base that flips the car off of the launcher. Alternatively, the object is flipped off by a plunger disposed in the center of the launcher wherein actuation of the plunger is controlled by the microprocessor of the toy or a mechanism actuated by the figure.

Figure 7:
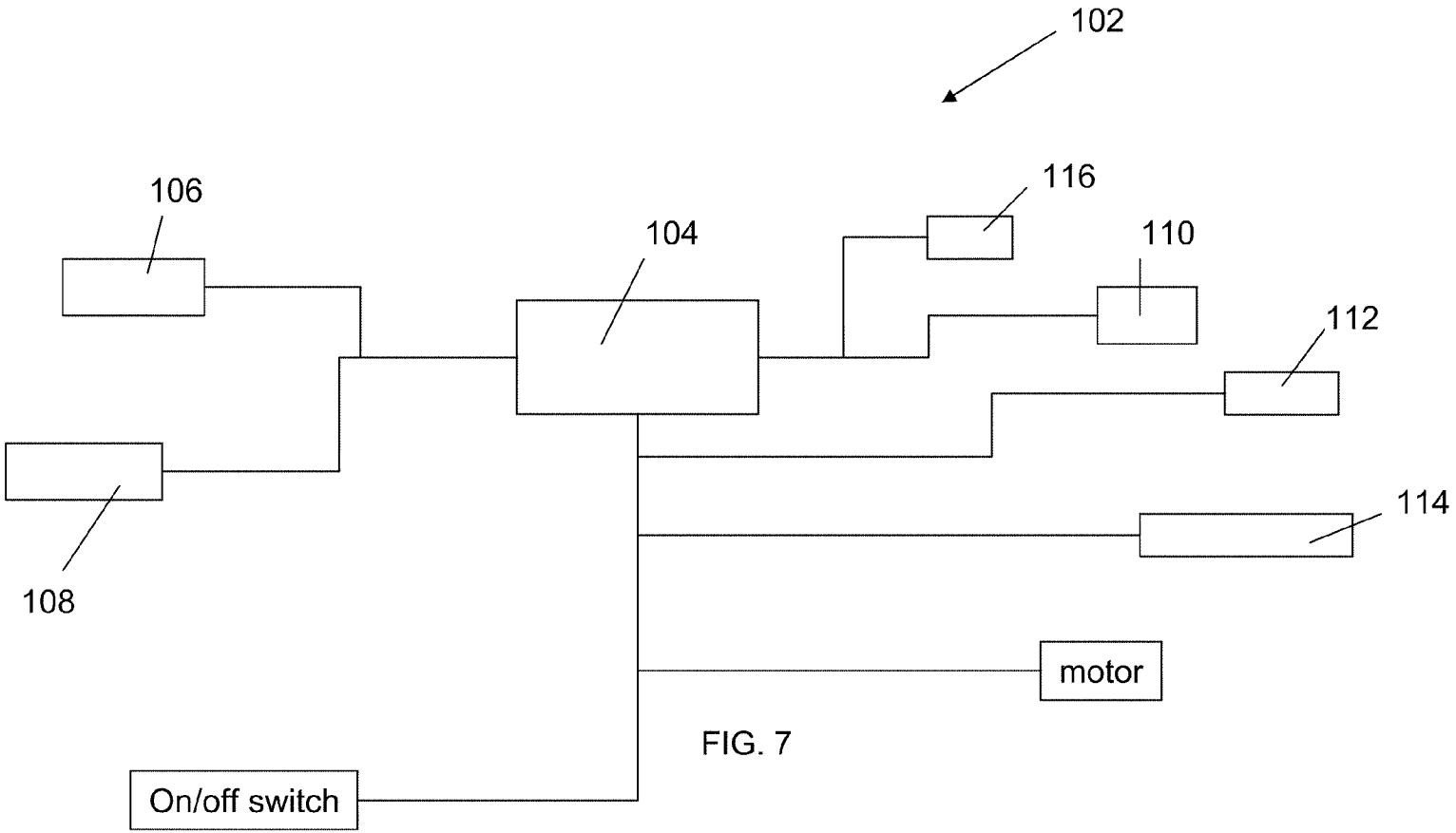
FIG. 7 is a schematic view of a control system for one embodiment of the toy.

Referring now to FIG. 7 a non-limiting example of a control system 102 of the toy is provided. Here a microprocessor 104 is coupled to a sensor 106 in the trigger, a sensor 108 in the launcher, a sensor 110 in the chest, a sensor 112 in at least one hand, a sensor 114 in the base portion receiving the weapons and a speaker 116. As discussed above the sensors will be positioned and configured to provide signals to the microprocessor when the sensor determines a change of state, wherein the signals are used to keep score (e.g., light up the leds on the scoreboard 100) and play the audio tracks. In one embodiment sensor 108 is coupled to plunger 138 to detect a car placed in the launcher.

Figure 8A:
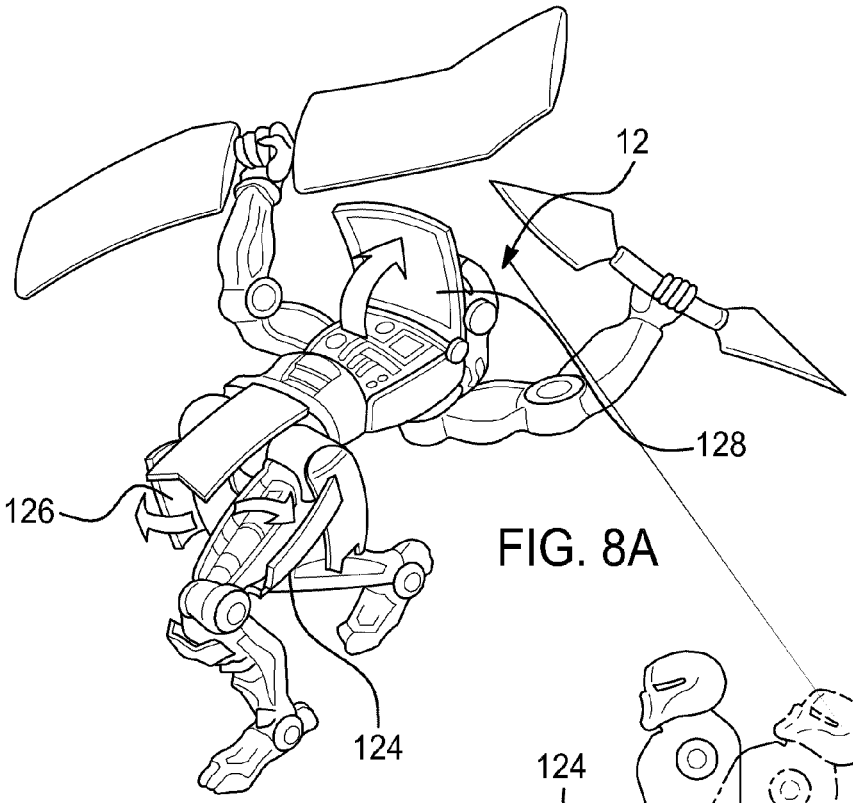
FIGS. 8A and 8B illustrate an alternative embodiment of the present invention.
Figure 8B:
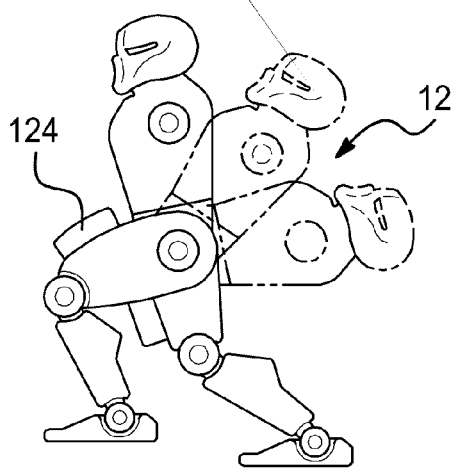

FIGS. 8A and 8B illustrate still another embodiment, wherein the figure is capable of two non-upright positions a partial defeat position 120 and a final defeat position 122. Also shown is that the figure has a pair of leg covers 124 and 126 and a chest cover 128 each of which opens when the figure is moved from partial defeat to final defeat. In one embodiment and when the last level or challenge has been completed the torso of the figure will fall first 45 degrees and then another 45 degrees wherein the leg covers 124 and 126 open and the chest cover 128 opens. Of course angles greater or less than 45 degrees is contemplated. Thus, the final stage of defeat may comprise a more elaborate victory over the Ninja or figure.

In still another alternative, hits or misses of the figure by objects launched by the launcher are recorded by signals from any one of the sensors 106, 108, 110, 112, 114 such that the microprocessor will, due to its driving circuit or by a sensor in the gear train or motor, know the position of the (e.g., rotation) of the upper portion of the figure and when the object is launched (e.g., the sensor in the trigger and launcher will indicate the position of the launcher and when it is launched) thus if the position of the launcher and the object are each indicating an aligned position (e.g., object hit chest) the microprocessor will record that as a hit. Conversely, if they are not properly aligned no hit is recorded and the microprocessor will provide signals to an audio driver play to the appropriate messages out of the speaker. Accordingly and in this embodiment, there is no need for a sensor on the chest as hits can be recorded by receiving signals indicating when the object was launched, the angular configuration of the launcher and the angular configuration of the figure. Accordingly, numerous methods for recording hits and misses are contemplated to be within the scope of the various embodiments of the present invention.

In order to win, the player must have defeated the figure a predetermined number of consecutive rounds of battle. On the final strike to the figure's chest plate the figure in one embodiment wobbles in an unsteady manner and says, "You have defeated me, you are the Master." The figure collapses backwards with electrical short circuit sounds (e.g., positions 8A-8B). If the player does not strike the figure's chest plate enough times within a round, the figure knocks the car off of the Battle Stand and says "Your no match for me, all too easy" or "That will teach you to challenge the Master" etc.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy, comprising:

a figure having an upper portion and a lower portion, the upper portion being moveably secured to the lower portion;

at least one appendage movably secured to the upper portion, the at least one appendage having a distal end with an item rotatably secured thereto;

an actuator disposed on an exterior surface of the upper portion, the actuator being configured for movement between a first position and a second position, the actuator retains the upper portion in a first configuration with respect to the lower portion when the actuator is in the first position and the upper portion moves to a second configuration with respect to the lower portion when the actuator is moved to the second position; and a launcher for launching an object at the figure and the actuator, wherein the lower portion of the figure and the launcher are secured to a base member and wherein the launcher is pivotally secured to the base member for launching movement in a first direction and the launcher is movably secured to the base member for movement in an aiming direction, the aiming direction being different than the first direction.

2. The toy as in claim 1, wherein the launcher comprises a platform having a plurality of tabs disposed along its periphery.

3. The toy as in claim 2, wherein the object is a miniature toy car slightly larger than the platform in at least one direction and the tabs are configured such that a portion of the tabs can engage the miniature toy car such that the miniature car can be positioned on the platform in a plurality of angular configurations with respect to the platform.

4. The toy as in claim 1, wherein the item is configured to resemble a weapon.

5. The toy as in claim 1, wherein the base member further comprises an elevated structure disposed between the launcher and the lower portion of the figure.

6. A toy, comprising:

a figure having an upper portion and a lower portion, the upper portion being moveably secured to the lower portion;

at least one appendage movably secured to the upper portion, the at least one appendage having a distal end with an item rotatably secured thereto;

an actuator disposed on an exterior surface of the upper portion, the actuator being cg for movement between a first position and a second position, the actuator retains the upper portion in a first configuration with respect to the lower portion when the actuator is in the first position and the upper portion moves to a second configuration with respect to the lower portion when the actuator is moved to the second position; and a launcher for launching an object at the figure and the actuator, wherein the figure further comprises a motor for engaging and rotating a gear train, the gear train being configured to move the upper portion with respect to the lower portion, move the at least one appendage with respect to the upper portion and rotate the item located at the distal end of the least one appendage when the gear train is rotated by the motor.

7. The toy as in claim 6, wherein the gear train moves the upper portion back and forth in a lateral direction and the gear train also moves the at least one appendage up and down as the upper portion moves in the lateral direction such that the item being rotated by the gear train is located in front of the figure in an alternating fashion.

8. A toy, comprising:

a figure having an upper portion and a lower portion, the upper portion being moveably secured to the lower portion;

at least one appendage movably secured to the upper portion, the at least one appendage having a distal end with an item rotatably secured thereto;

an actuator disposed on an exterior surface of the upper portion, the actuator being configured for movement between a first position and a second position, the actuator retains the upper portion in a first configuration with respect to the lower portion when the actuator is in the first position and the upper portion moves to a second configuration with respect to the lower portion when the actuator is moved to the second position; and a launcher for launching an object at the figure and the actuator, wherein the upper portion is also pivotally secured to the lower portion and biased towards the second configuration by a biasing force, wherein movement of the actuator to the second position allows the biasing force to pivot the upper portion to the second configuration and wherein the upper portion is configured as a torso of the figure and the lower portion is configured as a pair of legs and the actuator is disposed on a chest portion of the torso.

9. A toy, comprising:

a figure having a torso portion movably secured to the figure;

a pair of arms moveably secured to the torso portion each of the pair of arms having a distal end with an item rotatably secured thereto;

a motor for simultaneously rotating each item and for moving the torso such that each item is alternatively located in a position in front of the figure;

a release mechanism for maintaining the torso in an upright configuration;

an actuator for releasing the release mechanism, the actuator being disposed on an exterior surface of the torso; and a launcher for launching an object at the figure and the actuator.

10. The toy as in claim 9, wherein the lower portion of the figure and the launcher are secured to a base member and the launcher is pivotally secured to the base member for launching movement in a first direction, the launcher also being movably secured to the base member for movement in an aiming direction, the aiming direction being different than the first direction.

11. The toy as in claim 9, wherein the launcher comprises a platform having a plurality of tabs disposed along its periphery and the object is a miniature toy car slightly larger than the platform in at least one direction and the plurality of tabs are configured such that a portion of the plurality of tabs can engage the miniature toy car such that the miniature car can be positioned on the platform in a plurality of angular configurations with respect to the platform.

12. The toy as in claim 9, wherein the figure further comprises a motor for engaging and rotating a gear train, the gear train being configured to move the upper portion with respect to the lower portion, move the at least one appendage with respect to the upper portion and rotate the item located at the distal end of the least one appendage when the gear train is rotated by the motor.

13. The toy as in claim 12, wherein the gear train and the motor are disposed in the torso of the figure and the gear train moves the torso back and forth in a lateral direction while the gear train also moves the at least one appendage up and down as the torso moves in the lateral direction such that the items being rotated by the gear train are located in front of the figure in an alternating fashion.

14. The toy as in claim 9, wherein the item is configured to resemble a weapon and the torso is also pivotally secured to a pair of legs of the figure and the torso is biased toward a non-upright position by a biasing force, wherein release of the release mechanism by the actuator allows the biasing force to move the torso from the upright configuration to the non-upright position.

15. The toy as in claim 14, wherein the actuator is disposed on a chest portion of the torso and the figure further comprises a motor for engaging and rotating a gear train disposed within the torso, the gear train being configured to move the torso, move the pair of arms with respect to the torso and rotate the items located at the distal ends of the pair of arms when the gear train is rotated by the motor.

16. A toy, comprising:

a figure capable of being manipulated between a first position and a second position;

at least one appendage movably secured to the figure, the at least one appendage having a distal end with an item movably secured thereto;

a mechanism having a target, the target being configured for movement between a release position and a latched position, the mechanism retains the figure in the first position when the mechanism is in the latched position and the figure moves to the second position when the mechanism is moved toward the release position; and a launcher for launching an object at the target.

17. The toy as in claim 16, wherein the figure further comprises a motor for moving the item, the at least one appendage and a portion of the figure, wherein movement of the item, the least one appendage and the portion of the figure causes the target to be either protected from the object launched by the launcher or exposed to the object launched by the launcher, wherein movement of the item, the at least one appendage and the portion of the figure is in a reciprocating manner.

18. The toy as in claim 16, wherein the toy further comprises a motor for moving the item and the at least one appendage.

19. The toy as in claim 16, wherein the figure further comprises a torso movably mounted to a lower portion of the figure and wherein the at least one appendage is attached to the torso and the target is located on a surface of the torso.

20. A toy, comprising:

a figure having a torso portion secured to a lower portion of the figure;

a pair of arms secured to the torso portion each of the pair of arms having a distal end;

a mechanism for moving the torso such that each distal end of the pair of arms is alternatively located in a position in front of the figure;

a release mechanism for maintaining the torso in an upright configuration with respect to the lower portion of the figure;

an actuator for releasing the release mechanism, the actuator being disposed on an exterior surface of the figure; and an item for launching an object at the figure and the actuator.

* * * * *